United States Patent [19]

Wall

[11] 3,981,633

[45] Sept. 21, 1976

[54] PUMP

[75] Inventor: Karl Bertil Wall, Malmo, Sweden

[73] Assignee: AB Ljungmans Verkstader, Malmo, Sweden

[22] Filed: June 17, 1975

[21] Appl. No.: 587,788

[30] Foreign Application Priority Data

June 25, 1974 Sweden ..... 7408327

[52] U.S. Cl. ..... 417/474

[51] Int. Cl.[2] ..... F04B 43/08; F04B 43/12; F04B 45/06

[58] Field of Search ..... 417/474, 475, 477

[56] References Cited

UNITED STATES PATENTS

| | | | |
|---|---|---|---|
| 2,285,974 | 6/1942 | Huber | 417/475 |
| 3,229,643 | 1/1966 | Roudaut | 417/475 |
| 3,233,553 | 2/1966 | Chanton | 417/474 X |
| 3,429,266 | 2/1969 | Jones | 417/474 X |

*Primary Examiner*—Carlton R. Croyle
*Assistant Examiner*—Richard E. Gluck
*Attorney, Agent, or Firm*—Beveridge, DeGrandi, Kline & Lunsford

[57] ABSTRACT

A pump having an elastic hose fixed at its two ends and a hose actuator for conveying fluid from the hose inlet to the hose outlet. The hose actuator comprises means for imparting to the free portion of the hose such a progressive transverse undulating movement about an element immovably provided within the hose along the entire length thereof, while sealing or approximately sealing the hose at two opposite points, that the hose at all times and with constant cross section engages or substantially engages the element at other points along the hose for closing said hose.

10 Claims, 7 Drawing Figures

PUMP

BACKGROUND OF THE INVENTION

1. Field of the Invention

The present invention relates to a pump having an elastic hose fixed at its two ends and a hose actuator for conveying fluid from a hose inlet to a hose outlet.

2. Description of the Prior Art

Pumps of this general type have an elastic, straight or bent hose as the main component and are conventionally designated peristaltic pumps. The fluid is conveyed from the hose inlet to the hose outlet by means of reciprocating or rotating means which at all times squeeze the hose at one point to a flat substantially sealed section moving in one and the same direction along the hose, thereby pressing fluid ahead of it and sucking fluid behind it. Immediately before the flat section reaches the hose outlet, another flat section starts at the inlet, and the cycle is repeated. The capacity of these peristaltic pumps is limited in respect of pressure and head since the hose cannot effectively be supported by any non-flexible means. Furthermore, the elastic hose is subjected to considerable loads where it is squeezed flat, resulting in shorter hose life.

SUMMARY OF THE INVENTION

The present invention has for its object to obviate these disadvantages and to provide a pump which eliminates squeezing of the hose.

According to the invention, this is accomplished by imparting to the hose in a pump of the above-mentioned type an undulating, wave-like motion progressively along the hose while maintaining a seal between the hose and a solid member extending longitudinally therethrough.

BRIEF DESCRIPTION OF THE DRAWINGS

An embodiment of the invention will now be described in more detail in the following, reference being had to the accompanying drawings in which.

DESCRIPTION OF THE PREFERRED EMBODIMENTS

Figure 1:
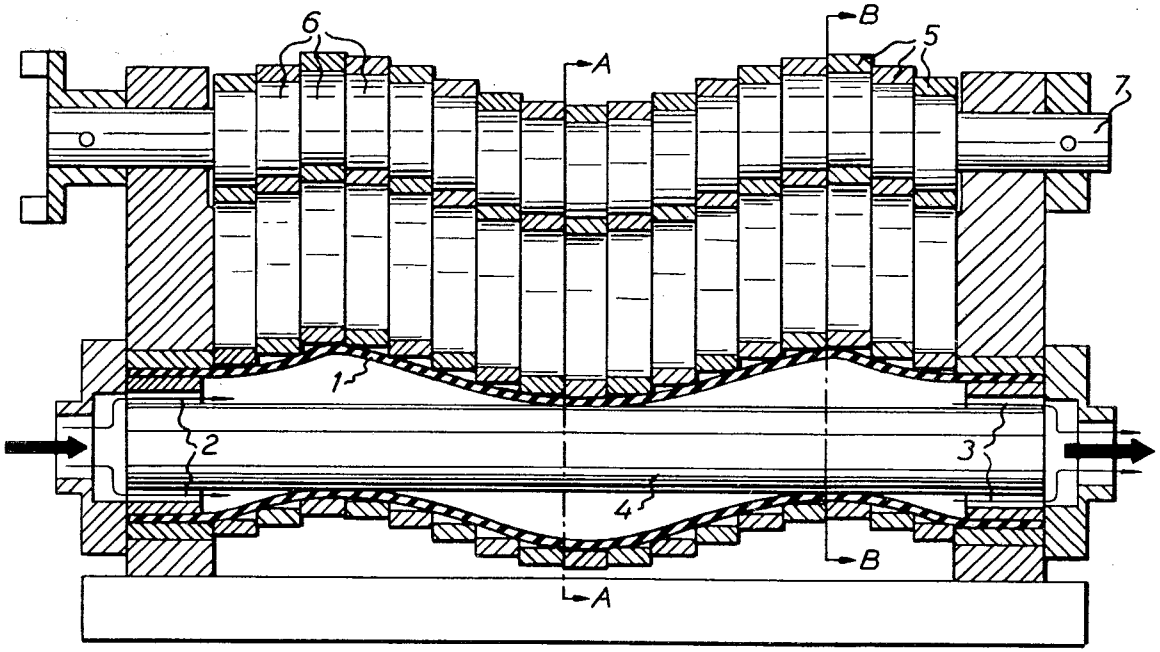
FIG. 1 shows a peristaltic pump according to this invention in longitudinal section.
Figure 2:
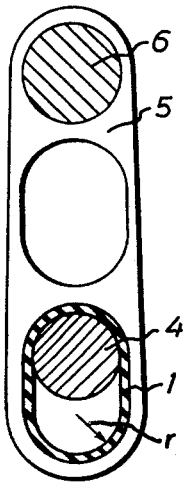
FIG. 2 shows a section on line A-A in FIG. 1.
Figure 3:
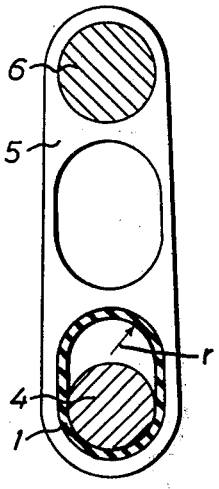
FIG. 3 shows a section on line B-B in FIG. 1.
Figure 4A:
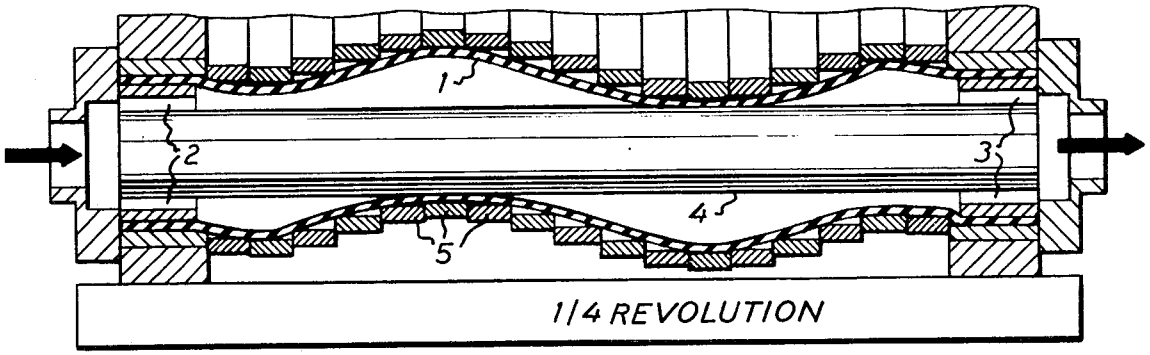
FIGS. 4A–4D show longitudinal sections of part of the pump during operation.
Figure 4B:
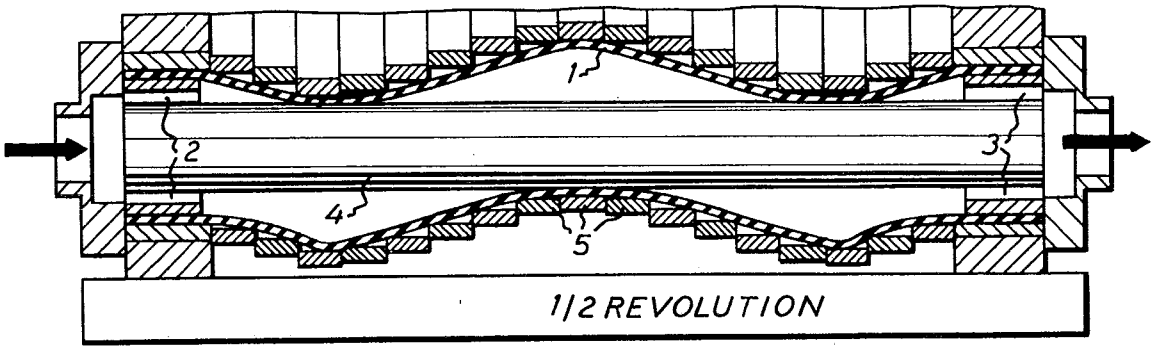
Figure 4C:
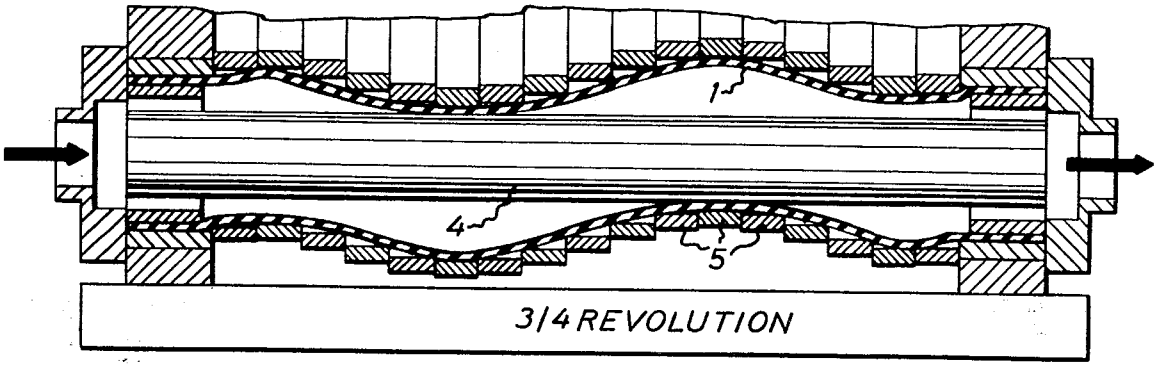
Figure 4D:
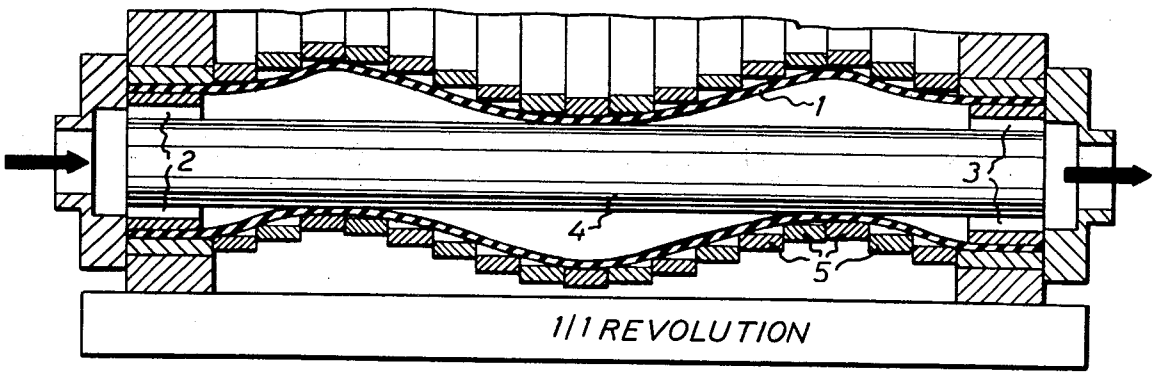

The peristaltic pump illustrated in FIG. 1 comprises a hose of elastic material, having an inlet 2 and an outlet 3 for fluid (liquid or gaseous). The hose is essentially oval in cross-section and, more particularly, is defined by two opposed, parallel straight-line portions and two semi-circular portions having the same radius $r$, the largest inner dimension of the hose being greater than $2r$. The hose has its ends secured in a pump housing and encompasses along its entire length an immovable circular rod 4 having the radius $r$, said rod being centered within the hose when the latter is not subjected to external forces. In this unstressed condition, fluid may flow from the inlet 2 to the outlet 3 in the space remaining between the rod 4 and the inner wall of the hose, more particularly in the two passages defined by the rod 4 and the lower and upper portions of the hose 1.

The free portion of the hose is supported by a number of juxtaposed, substantially identical connecting rods 5 and extends through an opening in one end of each connecting rod, the other end of which is rotatably mounted on a crankpin 6 of the crankshaft 7. The crankshaft 7 is mounted in the pump in order to impart, in known manner, an essentially vertical up-and-down movement to the lower ends of the connecting rods 5. The adjacent crankpins 6, or cranks are offset in the same direction at a constant angle relative to one another along the crankshaft 7 so that the sum of the angles is at least 360°. The individual cranks have, at least within the area of the crankshaft 7 where they collectively describe 360°, the same radial extent which is so chosen that the inner surface of the hose will engage the rod 4 in both the up-and-down end positions of the connecting rod strokes. If the hose is not moved into complete engagement with rod 4, the pump effect will be lower than if the engagement causes sealing. Preferably, the end portions of the crankshaft 7 are provided with additional cranks of a radius gradually decreasing towards the shaft bearings, in order to reduce the load on the hose at the points of attachment. In FIGS. 1 and 4A–4D, the pump according to the invention is shown to have seventeen cranks on the shaft 7, the central thirteen of which are angularly offset relative to one another through 30°, the sum of which angles totals 360°, with the radius of these cranks being such as to move the rods 5 a distance to cause the inner wall of the hose to engage the rod 4. The two cranks at each end of shaft 7 are of relatively smaller radius and therefore do not impart sufficient movement to the rods 5 mounted thereon to cause such engagement but rather serve to reduce loads, as mentioned above.

During operation of the crankshaft 7, the substantially vertical up-and-down movement of the connecting rods imparts to the hose 1 a progressive transverse undulating movement about the rod 4 and, since the shaft 7 has a portion with cranks describing 360°, the inner wall of the hose will at all times engage the rod 4 at least two opposed spaced apart points thereof, which means that the two passages located above and beneath the rod 4 are always closed between the inlet and outlet of the pump. This closing is propagated, upon rotation of crankshaft 7, along the hose in the manner illustrated in FIGS. 4A–4D, thereby producing a positive fluid movement from the inlet 2 to the outlet 3. It will be obvious that this fluid movement is accomplished without squeezing the hose. Because of the elasticity of the hose, no piston and piston pin arrangement is required for converting the rotation of the crankshaft into transverse movement on the hose 1, and the elastic hose will absorb the relatively minor tilting movement of the connecting rods which, in known crankshaft and connecting rod arrangements, is absorbed by the piston pin.

The fluid chambers formed in the top and bottom of the oval hose are isolated from one another by the contact of the opposed straight-line wall segments of the hose 1 with the circular rod 4. By providing openings in the lower end of the connecting rods 5 which conform to the configuration of the hose, expansion of the hose is prevented and the straight walls are maintained tangent to the rod 4 to provide a fluid seal along the length of the rod 4 within the area in which the hose passes through the connecting rods 5.

The embodiment illustrated can, of course, be varied in different ways within the scope of the invention. Thus, the cranks can be replaced by cams acting upon springloaded rods instead of connecting rods. Furthermore, the shaft 7 may be a shaft with eccentric discs. The hose 1 need not have the oval configuration illustrated in the drawings, nor is it necessary that the rod 4 has the circular form shown. The important thing is that the rod and the inner wall of the hose will always engage one another along at least two opposite surfaces of the rod, and that further engagement between the rod and the inner wall of the hose is obtained upon rotation of the crankshaft for closing the hose.

The above embodiment of the invention was described for purposes of illustration rather than limitation. All possible variations and modifications of the invention are understood as being included within the spirit and scope of the appended claims.

What I claim is:

1. A pump comprising, an elastic hose having open inlet and outlet ends, an elongated bar member mounted within said hose and extending substantially the full length thereof, hose actuator means operable to impart to the portion of said hose between said ends a progressive transverse undulating movement about said bar, said actuator means including movable means engaging and deflecting said hose for providing at all times a movable seal between said hose and said bar on opposite sides with said hose maintaining a substantially uniform cross section along its length during said movement, said hose cooperating with said bar to at least substantially seal from one another the spaces within said hose on said opposite sides of said bar.

2. The pump as defined in claim 1 wherein said actuator means includes a plurality of movable members engaging said hose at closely spaced positions along the length thereof, and means movingc said movable members in synchronization to impart to the hose said transverse undulating movement progressively from said inlet to said outlet end.

3. The pump as defined in claim 2 wherein said plurality of movable members comprise a plurality of juxtaposed, substantially identical rod members each having in one end an opening receiving and closely engaging said hose, said actuator means further including drive means engaging and cooperating with the other ends of said rod members for imparting thereto a substantially reciprocal movement transversely of said bar with mutual time lags between movement of the adjacent rods along said hose.

4. The pump as defined in claim 3 wherein said openings in said one end of said rods are substantially oval with the maximum dimension of the openings extending parallel to the direction of movement of the rods during operation of the pump, said oval openings being dimensioned to closely conform to the external surface of said hose.

5. The pump as defined in claim 3 wherein said rod members are connecting rods and wherein said drive means comprise a crankshaft having a plurality of cranks thereon operably connected one to each of said rods for imparting thereto a substantially linear reciprocating movement, successive cranks on said crankshaft being offset in the same direction and at the same angle along said crankshaft with the sum of said angles being at least 360°.

6. The pump as defined in claim 4 wherein a plurality of said cranks within the central portion of said crankshaft are all of the same radial extent and wherein said crankshaft has at least one crank at each end of said central portion which is of a shorter radial extent, the radial extent of the cranks at each end of said crank decreasing progressively towards the ends of said crankshaft.

7. The pump as defined in claim 1 wherein said hose is substantially oval in cross section and wherein said bar is of substantially circular cross section.

8. The pump as defined in claim 7 wherein said actuator means comprises a plurality of movable members engaging said hose at closely spaced positions along the length thereof, and means moving said movable members in synchronization to impart to the hose said transverse undulating movement progressively from said inlet to said outlet end.

9. The pump as defined in claim 8 wherein said plurality of movable members comprise a plurality of juxtaposed, substantially identical rod members each having in one end an opening receiving and closely engaging said hose, said actuator means including drive means engaging and cooperating with the other ends of said rod members for imparting thereto a substantially reciprocal movement transversely of said bar with mutual time lags between movement of the adjacent rods along said hose.

10. The pump as defined in claim 9 wherein said rod members are connecting rods and wherein said drive means comprises a crankshaft having a plurality of cranks thereon operably connected to each of said rods for imparting thereto a substantially linear reciprocating movement, succession cranks on said crankshaft being offset in the same direction and at the same angle only said crankshaft with the sum of said angles being at least 360°.

* * * * *